United States Patent [19]

Christian

[11] Patent Number: 5,018,204

[45] Date of Patent: May 21, 1991

[54] PORTABLE MUSICAL INSTRUMENT AMPLIFIER

[75] Inventor: David E. Christian, Danbury, Conn.

[73] Assignee: C. B. Labs, Inc., Bridgeport, Conn.

[21] Appl. No.: 505,459

[22] Filed: Apr. 6, 1990

Related U.S. Application Data

[63] Continuation of Ser. No. 273,415, Nov. 18, 1988, Pat. No. 4,944,016, which is a continuation-in-part of Ser. No. 121,166, Jan. 16, 1987, abandoned.

[51] Int. Cl.[5] ..... H04R 1/10

[52] U.S. Cl. ..... 381/74; 381/120; 381/118

[58] Field of Search ..... 381/74, 104, 120, 109, 381/118

[56] References Cited

U.S. PATENT DOCUMENTS

| | | | |
|---|---|---|---|
| 2,186,072 | 1/1940 | Huth | 381/74 |
| 2,826,644 | 3/1958 | Pease | 381/109 |
| 4,085,365 | 4/1978 | Reick | 381/104 |

*Primary Examiner*—Forester W. Isen

*Attorney, Agent, or Firm*—Michael L. Goldman

[57] ABSTRACT

The present invention relates to a musical instrument amplifier which is particularly useful for electric guitars. The amplifier has a rigid body for housing both the electronic system for amplifying and processing signals from the guitar and the system's power supply. An input plug connected to and projecting from the body is electrically coupled to the signal amplifying and processing system. When the plug is inserted into an output jack for an electric guitar, the body is rigidly carried by the guitar, and the guitar is operatively connected to the electrical amplifying and signal processing system without use of a loose interconnection cable. The amplifier is provided with an output jack, into which headphones are plugged to receive amplified signals from the guitar. By eliminating the conventional interconnection cable, the amplifier of the present invention can be used by musicians with increased flexibility and greater freedom of movement.

13 Claims, 4 Drawing Sheets

PORTABLE MUSICAL INSTRUMENT AMPLIFIER

This is a continuation of application Ser. No. 07/273,415, filed Nov. 18, 1988, now U.S. Pat. No. 4,911,016 on which is a continuation in part of Ser. No. 07/121,166, filed Nov. 16, 1987, now abandoned.

BACKGROUND OF THE INVENTION

Amplification systems for electronic musical instruments, particularly electric guitars are well known in the art. Generally, such amplifiers can be large, bulky devices driven by an AC power source and requiring separate, loose interconnection cables to both the guitar(s) and speaker(s). Due to the size and power requirements of such systems, they can have a limited utility. U.S. Pat. No. 4,532,847 to Youngblood appears to disclose such a system.

To enable musicians to practice playing their electric instruments when an AC power source is not available, portable battery-operated systems have been developed. Typically, as shown in FIG. 1, such amplifiers 12 are connected to an electric guitar 2 by a loose interconnection cable 8 with plug 6 being inserted in output jack 4 of guitar 2 and plug 10 being connected to amplifier 12. To monitor output from the amplifier without disturbing people nearby, a set of lightweight headphones 18 is connected to amplifier 12 via headphone cable 16 at the end of which is plug 14. Due to the presence of the interconnection cable and the physical size and weight of the amplifier unit 12 (e.g., 6.2 inches by 4.2 inches by 1.4 inches and approximately 15 ounces), these amplifier systems can be very clumsy and awkward to use, especially by a musician who changes positions (i.e., stands up or moves around) or alters the control settings. Consequently, musicians utilizing such systems typically remain seated with the amplifier resting nearby. An amplifier system similar to that shown in FIG. 1 is disclosed by U.S. Pat. No. 4,085,365 to Reick.

The awkwardness of utilizing a heavy, bulky amplifier with loose-hanging interconnection cables is discussed in U.S. Pat. No. 4,245,136 to Krauel, Jr. To obviate these problems, the device shown in this reference mounts the amplifier circuitry and batteries within the headphone. As a result, the overall size and weight of the headphones is significantly increased, making the amplifier uncomfortable to use, especially during long playing sessions. In addition, positioning the amplifier circuitry in the headphones can make the controls difficult to find and adjust, because the user, when wearing the headphones, cannot see where they are located. The number of controls employed should, therefore, be limited.

U.S. Pat. No. 4,428,268 to Ingoglia discloses another type of guitar amplifier which operates without using electrical energy. Specifically, the amplifier system includes a transmittal pickup plate on the guitar which is attached to sound transmittal tubes 18 that extend to earpieces 28. The sound quality of such an amplifier system tends to be of lower quality than that of an electrical amplifier system.

SUMMARY OF THE INVENTION

The present invention relates to a portable amplifier for musical instruments which avoids the above-discussed problems of prior art electrical amplifiers by eliminating the interconnection cable and plugging the amplifier directly into the instrument. These features and the small size of the amplifier (e.g. 3 oz. and body dimensions of 3.6 inches by 4.6 inches by 0.8 inches) enable musicians playing their instruments to move freely around without tripping over or having to manipulate lengthy interconnection cables between the instrument and a stationary amplifier. By plugging the amplifier of the present invention directly into the instrument (e.g., a guitar), the instrument carries the amplifier at a location where the controls are accessible and visible for easy adjustment.

The amplifier of the present invention includes a body defined by a rigid plastic case which contains the circuitry for an electronic amplifying and signal processing system and a power source for the system. The power source, which is accessible through a door in the case, is preferably a 9 volt battery.

Connected to and projecting from one end of the case is an input plug electrically coupled to the electric amplifying and signal processing system within the case. The plug is suitable for insertion into a mating output jack on the instrument to couple electrically the instrument to the amplification system. When operatively positioned in this manner, the body is physically carried by the instrument. In one embodiment of the present invention, the input plug is rigidly fixed to the body which is particularly suitable for a guitar with an output jack on its front face. In another embodiment, the input plug moves relative to the body which is very suitable for use with a guitar having an output plug in its side. Using the latter embodiment, the extent the body projects beyond the guitar's periphery can be lessened by moving the body relative to the jack.

The amplifier of the present invention is also provided with an output jack into which a plug for a set of headphones is inserted to monitor the amplifier's output. This plug and output jack combination could be eliminated, if desired, and the headphone cable could be wired permanently to the amplifier.

Positioned on the amplifier are control dials, including an on/off volume control dial, a tone control dial, an overdrive control switch, and an input level control. The circuitry underlying these controls, though new and unobvious, does not form the basis for the invention of this application but is the subject of my commonly-assigned, simultaneously-filed application entitled "Circuit For Controlling The Dynamic Range Of Electric Musical Instruments," which is hereby incorporated by reference. Since the amplifier is physically carried by the musical instrument, the controls are easily accessed and adjusted by a musician while playing his instrument. Feedback in response to such adjustments is obtained through the headphones.

DETAILED DESCRIPTION OF THE DRAWINGS

Figure 2:
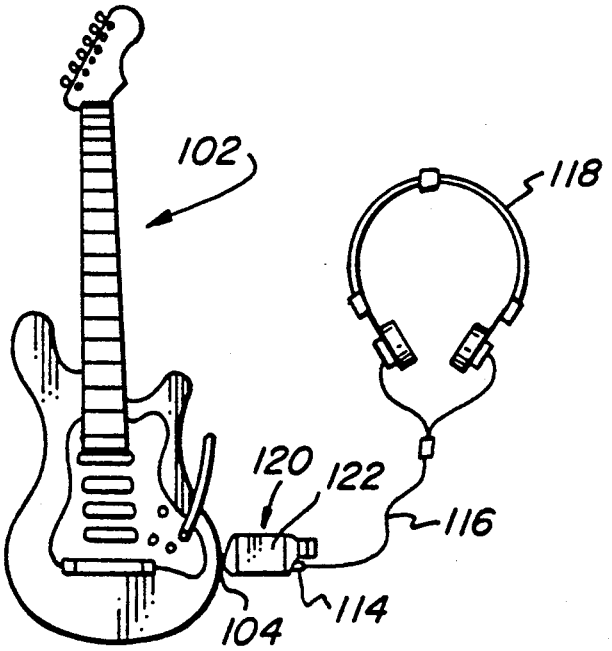
FIG. 2 is a schematic drawing of a guitar amplifier system according to the present invention.

FIG. 2 is a schematic drawing of a guitar amplifier system according to the present invention for which no interconnection cable between guitar 102 and amplifier 120 is needed. Instead, input plug 124 of portable amplifier 120 is inserted directly into output jack 104 of guitar 102. Again, output signals from guitar 102 are monitored through headphones 118 which are connected to the end of portable amplifier body 122 opposite input plug 124 by means of plug 114 at the end of headphone cable 116.

Figure 3:
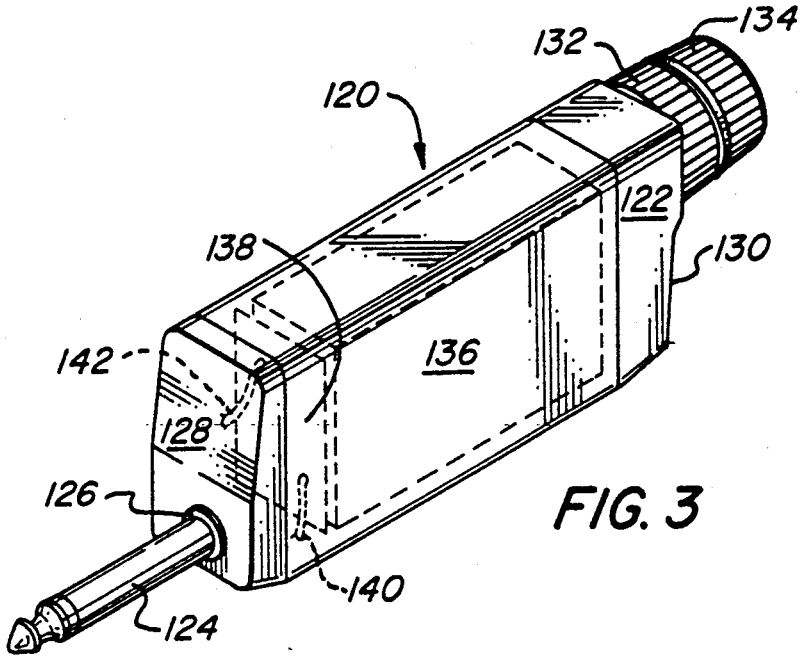
FIG. 3 is a perspective view of the guitar amplifier according to the present invention.

FIG. 3 is a perspective view of the guitar amplifier 120 of the present invention. Input plug 124 extends from clip 126 on face 128 of body 122 and is electrically coupled to the electrical amplifying and signal processing system in body 122 (not shown). Any conventional, compact amplifying system can be used, but it is preferred that the system described in my copending application be employed. On back surface 130 of body 122 are mounted tone control dial 132 and on/off volume control dial 134. The function and circuitry underlying these controls is fully discussed in my above referenced, copending application. Within body 122 is a power source 136 (shown in phantom) for amplifier 120. Preferably, this power source is a conventional 9 volt battery. Battery 136 is electrically coupled to amplifier 120 by means of a conventional 9 volt battery connector 138 having leads 140 and 142.

Figure 4:
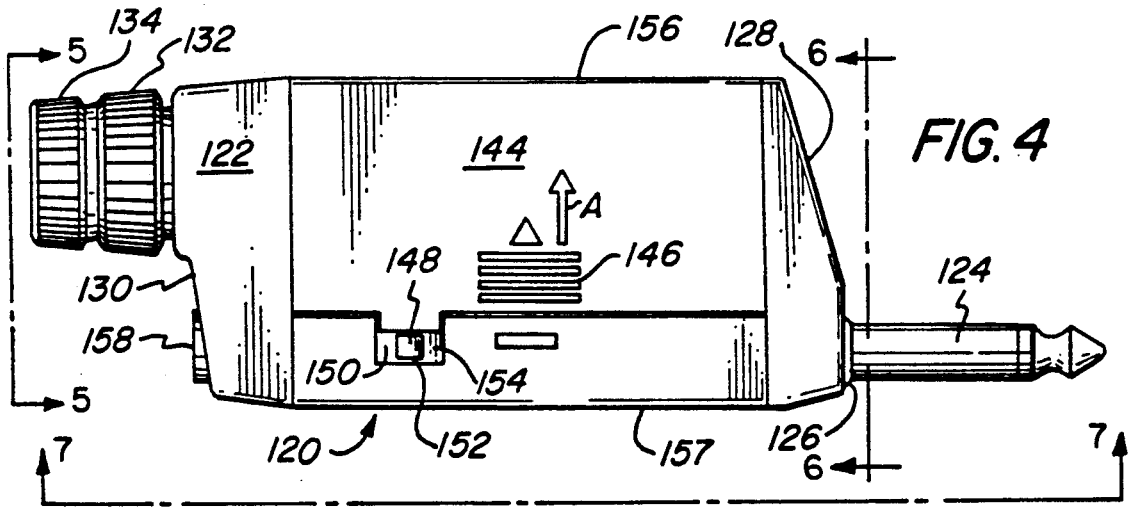
FIG. 4 is a side view of the guitar amplifier according to the present invention.

FIG. 4 is a side view of the guitar amplifier system according to the present invention showing door 144 through which battery 136 (not shown in FIG. 4) is accessed. Door 144 is upwardly slided by pushing door opening surface 146 upward in the direction of arrow A toward top surface 156. Also mounted on the same side of amplifier 120 as door 144 is switch 148 by which the degree of the amplifier overdrive can be modified. Switch 148 is movable between a full distortion setting 150, an edge or moderate distortion setting 152, and a clean or no distortion setting 154. The function and circuitry for these settings is fully discussed in my copending application. FIG. 4 also shows output jack 158 mounted on back surface 130 which is shown in more detail in FIG. 5.

Figure 5:
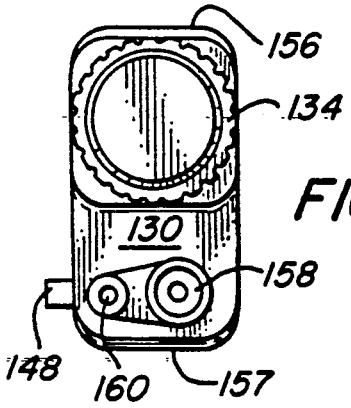
FIG. 5 is an end view of the guitar amplifier of the present invention taken along line 5—5 of FIG. 4.

FIG. 5 is an end view of the guitar amplifier of the present invention taken along line 5—5 of FIG. 4. Besides having output jack 158 into which a mating headphone jack can be plugged to monitor output, back surface 130 is also provided with an input jack 160 for providing the amplifier with auxiliary input signals besides those received from the guitar— i.e., signals from a radio, phonograph, or tape player. These auxiliary signals are summed or mixed with the signals from the electric guitar for simultaneous monitoring through headphones 118 or another output device.

Figure 1:
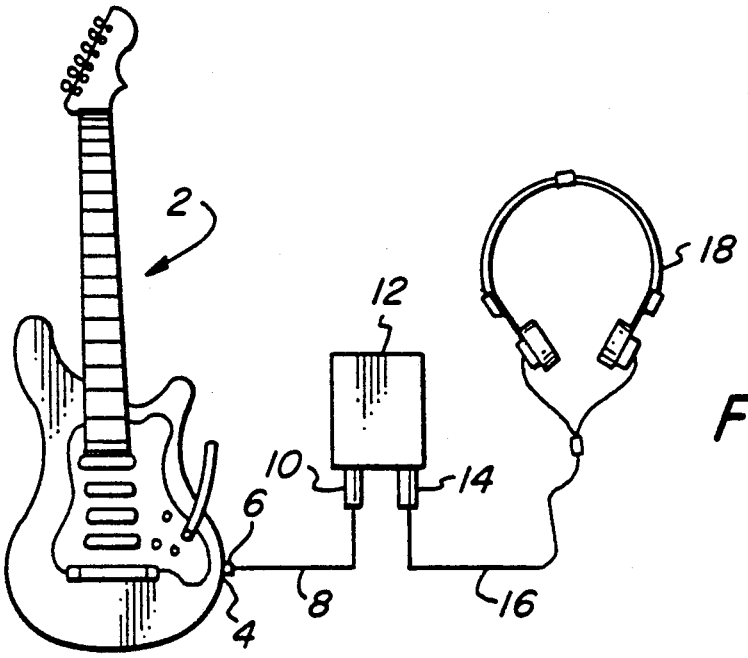
FIG. 1 is a schematic drawing of a prior art guitar amplifier system.
Figure 6:
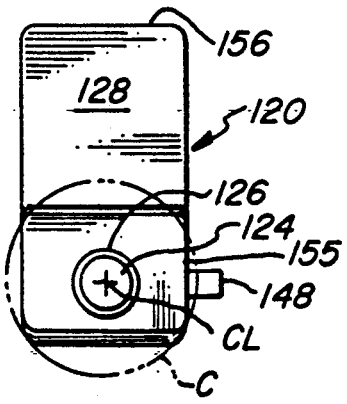
FIG. 6 is another end view of the guitar amplifier according to the present invention taken along line 6—6 of FIG. 4.

FIG. 6 is another end view of the guitar amplifier of the present invention taken along line 6—6 of FIG. 4. As shown in this drawing, center line CL of input plug 124 forms the center for circle C which circumscribes bottom wall 157 and the lower part of side walls 155 of amplifier 120. As discussed in more detail with respect to FIG. 8, it has been discovered that if the diameter of circle C is more than 0.800 inches (i.e., bottom wall 157 and the lower portion of the side walls 155 of amplifier 120 are within 0.800 inches of center line CL of input plug 124), amplifier 120 can be used in conjunction with most guitars regardless of whether it has a face-mounted (FIG. 8) or side-mounted output jack (FIGS. 1 and 2). The diameter of circle C must be less than or equal to 0.800 inches.

Figure 7:
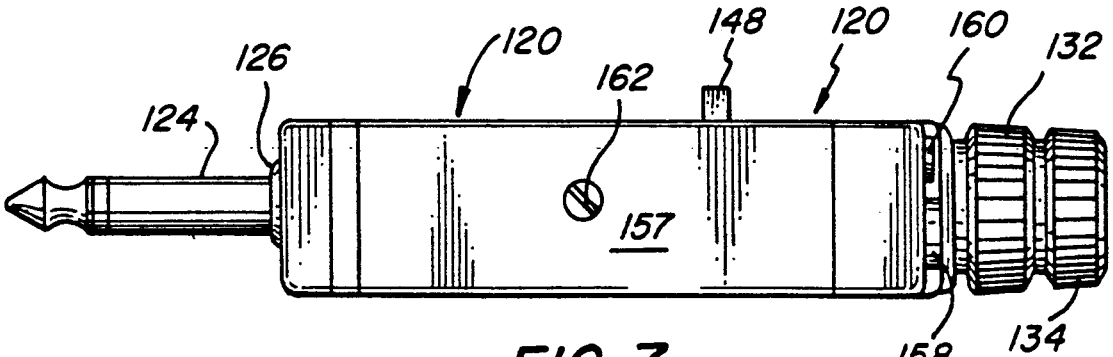
FIG. 7 is a bottom view of a guitar amplifier system according to the present invention taken along line 7—7 of FIG. 4.

FIG. 7 is a bottom view of the guitar amplifier according to the present invention taken along line 7—7 of FIG. 4 showing input level control 162. The circuitry and function underlying input level control 162 is fully discussed in my above-referenced, copending application.

Figure 8:
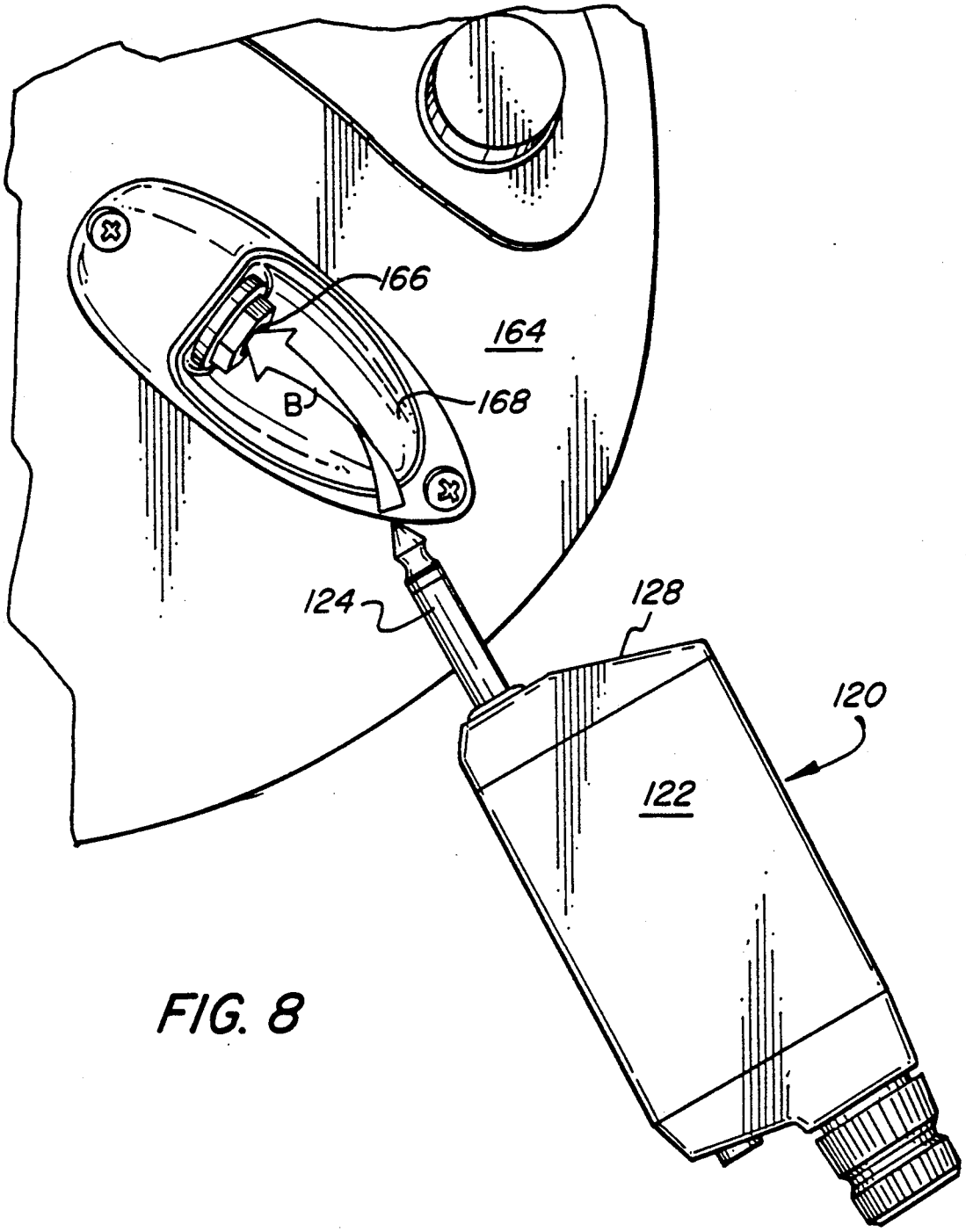
FIG. 8 is a front view of an electric guitar with an output jack on its front face into which the guitar amplifier of the present invention is inserted.

FIG. 8 is a front view of an electric guitar with an output jack 166 transversely mounted on its face 164. This is distinct from guitar 102 shown in FIG. 2 where output jack 104 is mounted on the side of the guitar. In guitars with output jacks like that shown in FIG. 8, output jack 166 is recessed below the surface of face 164, and output jack slot 168 slopes downwardly toward output jack 166. As a result, it is necessary for amplifier 120, and particularly its body 122, to have a configuration which can be received by guitar output jack slot 168 as input plug 124 is inserted into output jack 166, as shown by arrow B. Accordingly, as discussed with respect to FIG. 6, it is necessary that center line CL of input jack 124 can be no more than 0.800 inches from bottom wall 157 and the lower portions of side walls 155. Amplifier 120 is thus capable of use in conjunction with most electric guitars regardless of where its output jack is located.

Figure 9:
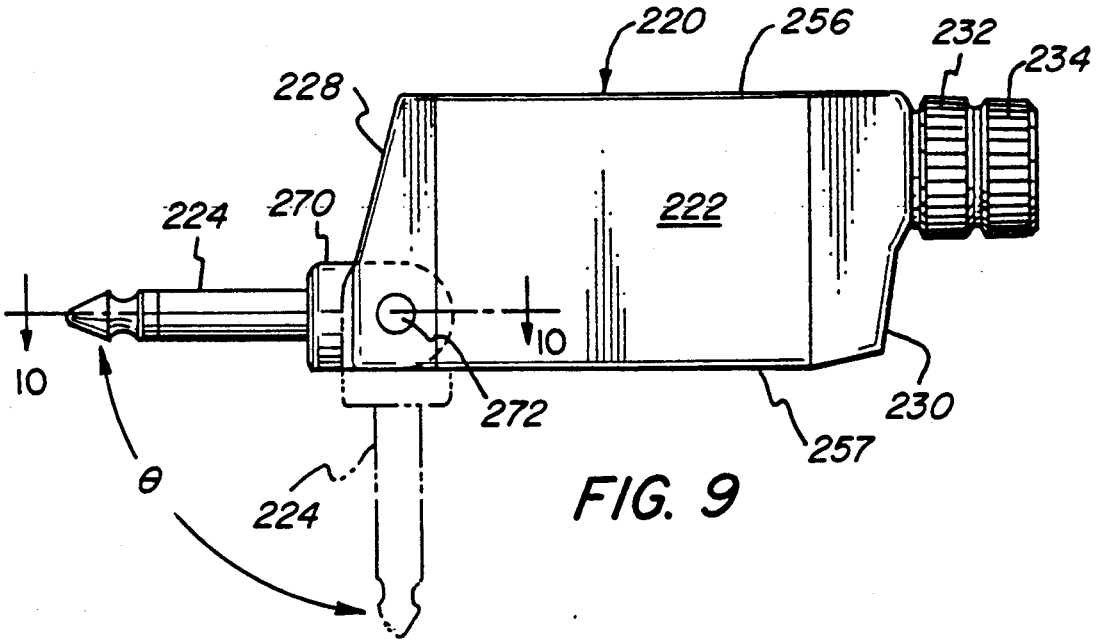
FIG. 9 is a side view of a second embodiment of the guitar amplifier according to the present invention.
Figure 10:
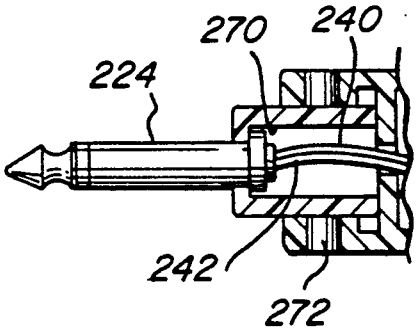
FIG. 10 is a top cross-sectional view of the second embodiment of the guitar amplifier according to the present invention taken along line 10—10 of FIG. 9.

FIG. 9 is a side view of a second embodiment of the guitar amplifier 220 of the present invention, while FIG. 10 is a top cross-sectional view of the second embodiment of the guitar amplifier of the present invention taken along line 10—10 of FIG. 9. As in the first embodiment, amplifier 220 is provided with a body 222 having top surface 256, bottom surface 257, and back 230 with tone control dial 232 and on/off volume control dial 234. Unlike the first embodiment where input plug 124 was rigidly fixed to face 128, input plug 224 of the second embodiment is movable relative to face 228 (and body 222). This is accomplished by mounting input plug 224 to face 228 by means of adaptor 270 which is pivotally connected to body 222 by means of transversely-mounted pivot pin 272. As a result, input plug 224 can be moved about an angle $\theta$ of about 90° with respect to body 222, as shown in FIG. 9. Input plug 224 is electrically connected to the electronic amplifying and signal processing system (not shown) within amplifier 220 by leads 240 and 242.

Although the invention has been described in detail for the purpose of illustration, it is understood that such detail is solely for that purpose, and variations can be made therein by those skilled in the art without departing from the spirit and scope of the invention which is defined by the following claims.

I claim:

1. A portable musical instrument amplifier comprising:

an electronic amplifying and signal processing system;

a body containing said electronic amplifying and signal processing system;

an input plug directly rigidly attached to and projecting from said body and electrically coupled to said electronic amplifying and signal processing system, wherein said body has essentially planar end, side, and bottom surfaces with a majority of the end surface forming an obtuse angle with said input plug; and headphone connection means in said body adapted to connect physically and electrically said electronic amplifying and signal processing system to headphones, whereby, when said input plug is inserted into a musical instrument output jack, said electronic amplifying and signal processing system produces an amplified signal from the instrument capable of being heard with headphones.

2. A portable musical instrument amplifier according to claim 1 further comprising:

headphones electrically coupled, through said headphone connection means, to said electronic amplifying and signal processing system to receive the amplified signal.

3. A portable musical instrument amplifier according to claim 2, wherein said headphones have extending from them a cable terminating with a plug and wherein said headphone connection means comprises:

a jack mounted to said body and electrically coupled to said electronic amplifying and signal processing system for receiving the headphone plug.

4. A portable musical instrument amplifier according to claim 1, wherein said instrument is a guitar.

5. A portable musical instrument amplifier according to claim 1, further comprising:

a battery as a power source for said electronic amplifying and signal processing system, wherein said battery is positioned within said body and accessed through a door on said body.

6. A portable musical instrument amplifier according to claim 1, further comprising:

control means for said electronic amplifying and signal processing system exteriorly mounted on said body.

7. A portable musical instrument amplifier comprising:

an electronic amplifying and signal processing system;

a body containing said electronic amplifying and signal processing system;

an input plug directly rigidly attached to and projecting from said body and electrically coupled to said electronic amplifying and signal processing system, wherein said body has end, side, and bottom surfaces and wherein said input plug is non-centrally attached to the end surface on at least one axis; and headphone connection means in said body adapted to connect physically and electrically said electronic amplifying and signal processing system to headphones, whereby, when said input plug is inserted into a musical instrument output jack, said electronic amplifying and signal processing system produces an amplified signal from the instrument capable of being heard with headphones.

8. A portable musical instrument amplifier according to claim 7 further comprising:

headphones electrically coupled, through said headphone connection means, to said electronic amplifying and signal processing system to receive the amplified signal.

9. A portable musical instrument amplifier according to claim 8, wherein said headphones have extending from them a cable terminating with a plug and wherein said headphone connection means comprises:

a jack mounted to said body and electrically coupled to said electronic amplifying and signal processing system for receiving the headphone plug.

10. A portable musical instrument amplifier according to claim 7 further comprising:

a battery as a power source for said electronic amplifying and signal processing system, wherein said battery is positioned within said body and accessed through a door on said body.

11. A portable musical instrument amplifier according to claim 7 further comprising:

control means for said electronic amplifying and signal processing system exteriorly mounted on said body.

12. A portable musical instrument amplifier according to claim 7, wherein said instrument is a guitar.

13. A portable musical instrument amplifier according to claim 7, wherein the end, side, and bottom surfaces are essentially planar with a majority of the end surface forming an obtuse angle with said input plug.

* * * * *